US009552704B2

(12) United States Patent
Poole et al.

(10) Patent No.: US 9,552,704 B2
(45) Date of Patent: Jan. 24, 2017

(54) WAGERING GAME HAVING MULTI-ARRAY SYMBOL PLACEMENT FEATURE

(71) Applicant: WMS Gaming Inc., Waukegan, IL (US)

(72) Inventors: Nicholas Poole, Chicago, IL (US); Jamie W. Vann, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 322 days.

(21) Appl. No.: 14/207,128

(22) Filed: Mar. 12, 2014

(65) Prior Publication Data

US 2014/0274295 A1 Sep. 18, 2014

Related U.S. Application Data

(60) Provisional application No. 61/782,592, filed on Mar. 14, 2013.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
USPC ..... 463/20, 22, 25
See application file for complete search history.

(56) References Cited

U.S. PATENT DOCUMENTS

| | | | |
|---|---|---|---|
| 5,732,950 | A | 3/1998 | Moody |
| 5,823,873 | A | 10/1998 | Moody |
| 5,833,537 | A | 11/1998 | Barrie |
| 5,976,016 | A | 11/1999 | Moody et al. |
| 5,997,401 | A | 12/1999 | Crawford |
| 6,007,066 | A | 12/1999 | Moody |
| 6,056,642 | A | 5/2000 | Bennett |
| 6,089,977 | A | 7/2000 | Bennett |
| 6,098,985 | A | 8/2000 | Moody |
| 6,120,378 | A | 9/2000 | Moody et al. |
| 6,159,095 | A | 12/2000 | Frohm et al. |
| 6,203,428 | B1 | 3/2001 | Giobbi et al. |
| 6,251,013 | B1 | 6/2001 | Bennett |
| 6,270,412 | B1 | 8/2001 | Crawford et al. |
| 6,315,291 | B1 | 11/2001 | Moody |

(Continued)

FOREIGN PATENT DOCUMENTS

| | | |
|---|---|---|
| EP | 0060018 | 9/1982 |
| EP | 0062433 | 10/1982 |

(Continued)

*Primary Examiner* — Pierre E Elisca
(74) *Attorney, Agent, or Firm* — Nixon Peabody LLP

(57) ABSTRACT

A gaming system includes one or more display devices, one or more processors, and one or more memory devices. The one or more memory devices store instructions that, when executed by at least one of the one or more processors, cause the gaming system to (i) display, on at least one of one or more display devices, a first symbol array and a second symbol array, (ii) in response to a triggering symbol appearing in the first symbol array, place a first symbol into a number of symbol positions within the second symbol array, the number being defined by a quantifier associated with the triggering symbol, (iii) provide an award based on one or more winning symbol combinations in the second array with the first symbols placed in the symbol positions.

31 Claims, 9 Drawing Sheets

(56) References Cited

U.S. PATENT DOCUMENTS

| | | | |
|---|---|---|---|
| 6,517,074 | B1 | 2/2003 | Moody et al. |
| 6,517,433 | B2 | 2/2003 | Loose et al. |
| 6,561,898 | B2 | 5/2003 | Moody |
| 6,568,680 | B1 | 5/2003 | Moody et al. |
| 6,652,377 | B1 | 11/2003 | Moody |
| 6,918,832 | B2 | 7/2005 | Baerlocher et al. |
| 6,955,356 | B2 | 10/2005 | Moody |
| 6,964,418 | B2 | 11/2005 | Moody |
| 6,981,635 | B1 | 1/2006 | Hughs-Baird et al. |
| 7,137,628 | B2 | 11/2006 | Moody |
| 7,222,857 | B2 | 5/2007 | Moody |
| 7,222,858 | B2 | 5/2007 | Moody |
| 7,396,279 | B2 | 7/2008 | Berman et al. |
| 7,404,762 | B2 | 7/2008 | Moody |
| 7,431,644 | B2 | 10/2008 | Moody |
| 7,526,736 | B2 | 4/2009 | Kaminkow et al. |
| 7,527,557 | B2 | 5/2009 | Jackson |
| 8,187,079 | B2 | 5/2012 | Gomez et al. |
| 2003/0186737 | A1 | 10/2003 | Bennett et al. |
| 2004/0097280 | A1 | 5/2004 | Gauselmann |
| 2005/0049030 | A1 | 3/2005 | Tachikawa |
| 2010/0069160 | A1 | 3/2010 | Barrett et al. |
| 2010/0234099 | A1 | 9/2010 | Rasmussen et al. |
| 2011/0105218 | A1 | 5/2011 | Anderson et al. |
| 2011/0218034 | A1 | 9/2011 | Barclay et al. |
| 2012/0034969 | A1 | 2/2012 | Singer et al. |
| 2013/0217465 | A1* | 8/2013 | Jaffe ..... G07F 17/3213 463/20 |
| 2013/0303260 | A1 | 11/2013 | Louie et al. |
| 2013/0324213 | A1* | 12/2013 | Aoki ..... G07F 17/326 463/20 |
| 2014/0094274 | A1* | 4/2014 | Guinn ..... G07F 17/326 463/25 |
| 2014/0274288 | A1* | 9/2014 | Hornik ..... G07F 17/326 463/20 |

FOREIGN PATENT DOCUMENTS

| | | |
|---|---|---|
| GB | 2119991 | 11/1983 |
| GB | 2137392 | 10/1984 |

* cited by examiner

WAGERING GAME HAVING MULTI-ARRAY SYMBOL PLACEMENT FEATURE

CROSS-REFERENCE TO RELATED APPLICATIONS

This application claims the benefit of and priority to U.S. Provisional Patent Application No. 61/782,592 titled "Wagering Game Having Multi-Array Symbol Placement Feature" and filed on Mar. 14, 2013, which is incorporated herein by reference in its respective entirety.

COPYRIGHT

A portion of the disclosure of this patent document contains material which is subject to copyright protection. The copyright owner has no objection to the facsimile reproduction by anyone of the patent disclosure as it appears in the U.S. Patent and Trademark Office patent files or records, but otherwise reserves all copyright rights whatsoever.

TECHNICAL FIELD

The present disclosure relates generally to wagering games, as well as wagering game terminals and wagering game systems. More particularly, the present disclosure relates to systems, methods, and devices for altering symbols with a symbol array based on a triggering event in a different symbol array.

BACKGROUND

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One way that players may experience a heightened entertainment level while playing the wagering game is when the player senses that he or she has a better chance of achieving a winning outcome. In some wagering games, there are symbol arrays that are displayed to the player and that provide the multiple opportunities for winning outcomes. The present invention is directed to a wagering game having multiple symbol arrays, wherein one of the symbol arrays triggers the placement of symbols in the other symbol array in a manner that provides the player with a heightened entertainment level because the player perceives that he or she has a better opportunity for achieving a winning outcome.

SUMMARY

One aspect of the present invention relates to a gaming system that includes one or more display devices, one or more processors, and one or more memory devices. The one or more memory devices store instructions that, when executed by at least one of the one or more processors, cause the gaming system to (i) display, on at least one of one or more display devices, a first symbol array and a second symbol array, (ii) in response to a triggering symbol appearing in the first symbol array, place a first symbol into a number of symbol positions within the second symbol array, the number being defined by a quantifier associated with the triggering symbol, and (iii) provide an award based on one or more winning symbol combinations in the second array with the first symbols placed in the symbol positions. The present invention also contemplates a method for operating such as gaming system and a method for playing a wagering game in accordance with items (i) to (iii).

In accordance with another aspect, the present invention relates to a gaming system that includes one or more display devices, one or more processors, and one or more memory devices. The one or more memory devices store instructions that, when executed by at least one of the one or more processors, cause the gaming system to (i) display, on at least one of the one or more display devices, a first plurality of symbol-bearing reels that form a first symbol array, the plurality of symbol-bearing reels including at least one triggering symbol, the triggering symbol including a quantifier associated therewith, (ii) display, on at least one of the one or more display devices, a second plurality of symbol-bearing reels that form a second symbol array, the second symbol array being larger than the first symbol array, (iii) move and stop the first plurality of symbol-bearing reels to populate the first symbol array with symbols, (iv) in response to a triggering symbol appearing in the first symbol array, fill a number of symbol positions within the second symbol array with a first symbol, the number being defined by the quantifier associated with the triggering symbol, (v) move and stop the second plurality of symbol-bearing reels to populate the second symbol array with symbols, the second symbol array including the symbol positions filled with the first symbol after the second plurality of symbol-bearing reels are stopped, and (vi) provide an award based on one or more winning symbol combinations in the second array with the first symbols filled in the symbol positions. The present invention also contemplates a method for operating such as gaming system and a method for playing a wagering game in accordance with items (i) to (vi).

In accordance with a further aspect, the present invention relates to a gaming system that includes one or more display devices, one or more processors, and one or more memory devices. The one or more memory devices store instructions that, when executed by at least one of the one or more processors, cause the gaming system to (i) display, on at least one of one or more display devices, a first symbol array and a second symbol array, (ii) in response to a triggering symbol appearing in the first symbol array, select, by at least one of the one or more processors, a symbol-placement pattern from a first set of symbol-placement patterns for the second array, the symbol-placement pattern including multiple symbol positions, (iii) place a first symbol into the multiple symbol positions defined by the selected symbol-placement pattern for the second symbol array, and (iv) provide an award based on one or more winning symbol combinations in the second array with the first symbols placed into the symbol positions. The present invention also contemplates a method for operating such as gaming system and a method for playing a wagering game in accordance with items (i) to (iv).

In accordance with yet another aspect, the present invention relates to a gaming system that includes one or more display devices, one or more processors, and one or more memory devices. The one or more memory devices store instructions that, when executed by at least one of the one or more processors, cause the gaming system to (i) display, on at least one of the one or more display devices, a first symbol array and a second symbol array that is distinct from the first symbol array, the first symbol array capable of displaying a first triggering symbol and a second triggering symbol, the first triggering symbol being associated with a first number "n", the second triggering symbol being associated with a second number "m", the second number "m" being larger than the first number "n", (ii) in response to only the first triggering symbol appearing in the first symbol array, place a first symbol into "n" number of symbol positions within the second symbol array, (iii) in response to only the second triggering symbol appearing in the first symbol array, place the first symbol into "m" number of symbol positions within the second symbol array, (iv) in response to both the first triggering symbol and the second triggering symbol appearing in the first symbol array, place the first symbol into "x" number of symbol positions within the second symbol array, wherein the number "x" is equal to the summation of the number "n" and the number "m", and (v) provide an award based on winning symbol combinations in the second array with the first symbols placed into the symbol positions. The present invention also contemplates a method for operating such as gaming system and a method for playing a wagering game in accordance with items (i) to (v).

Other aspects of the invention include physical machine-readable storage media including instructions which, when executed by one or more processors resident to a gaming machine, cause the one or more processors to perform operations and methods of the gaming system that are set forth above.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and best modes for carrying out the present invention when taken in connection with the accompanying drawings and the appended claims.

Figure 1:
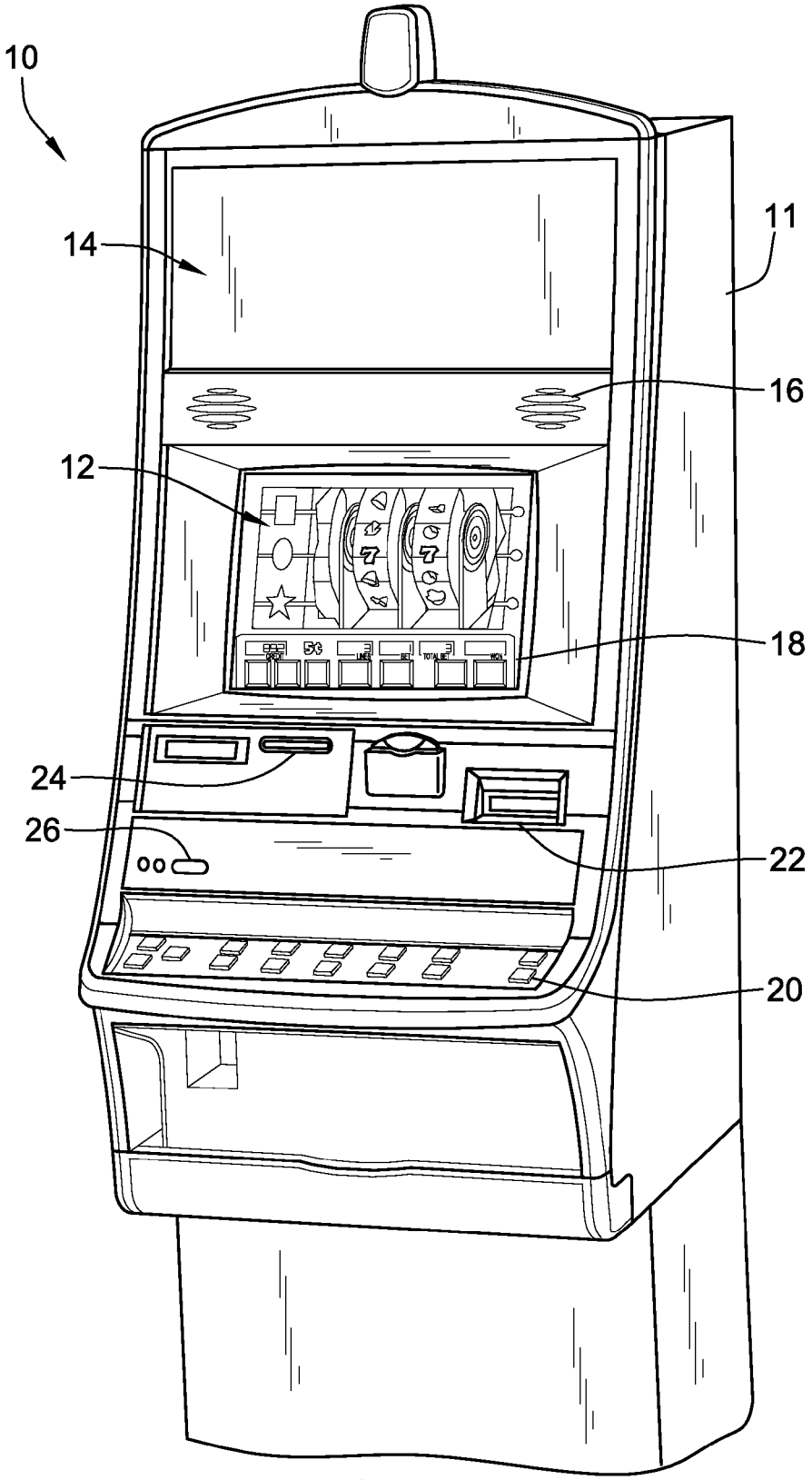
FIG. 1 (PRIOR ART)
FIG. 1 is a perspective-view illustration of an exemplary free-standing gaming terminal according to aspects of the present disclosure.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, titled "Reel Spinning Slot Machine With Superimposed Video Image," U.S. Patent Application Publication Nos. US2010/0069160, titled "Handheld Wagering Game Machine And Docking Unit," and US2010/0234099, titled "Wagering Game System With Docking Stations" which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
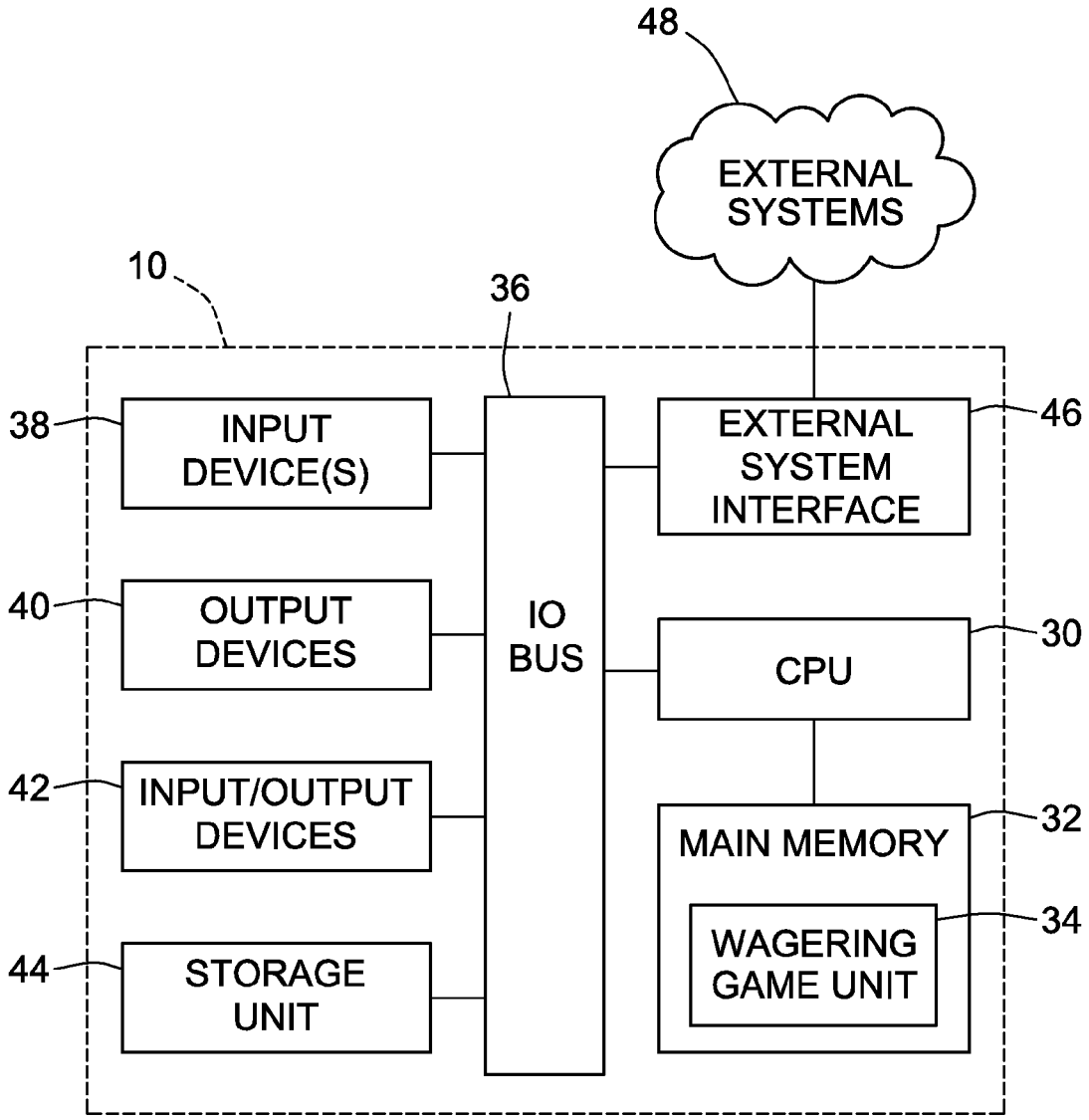
FIG. 2 (PRIOR ART)
FIG. 2 is a schematic diagram of an example of a gaming system according to aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
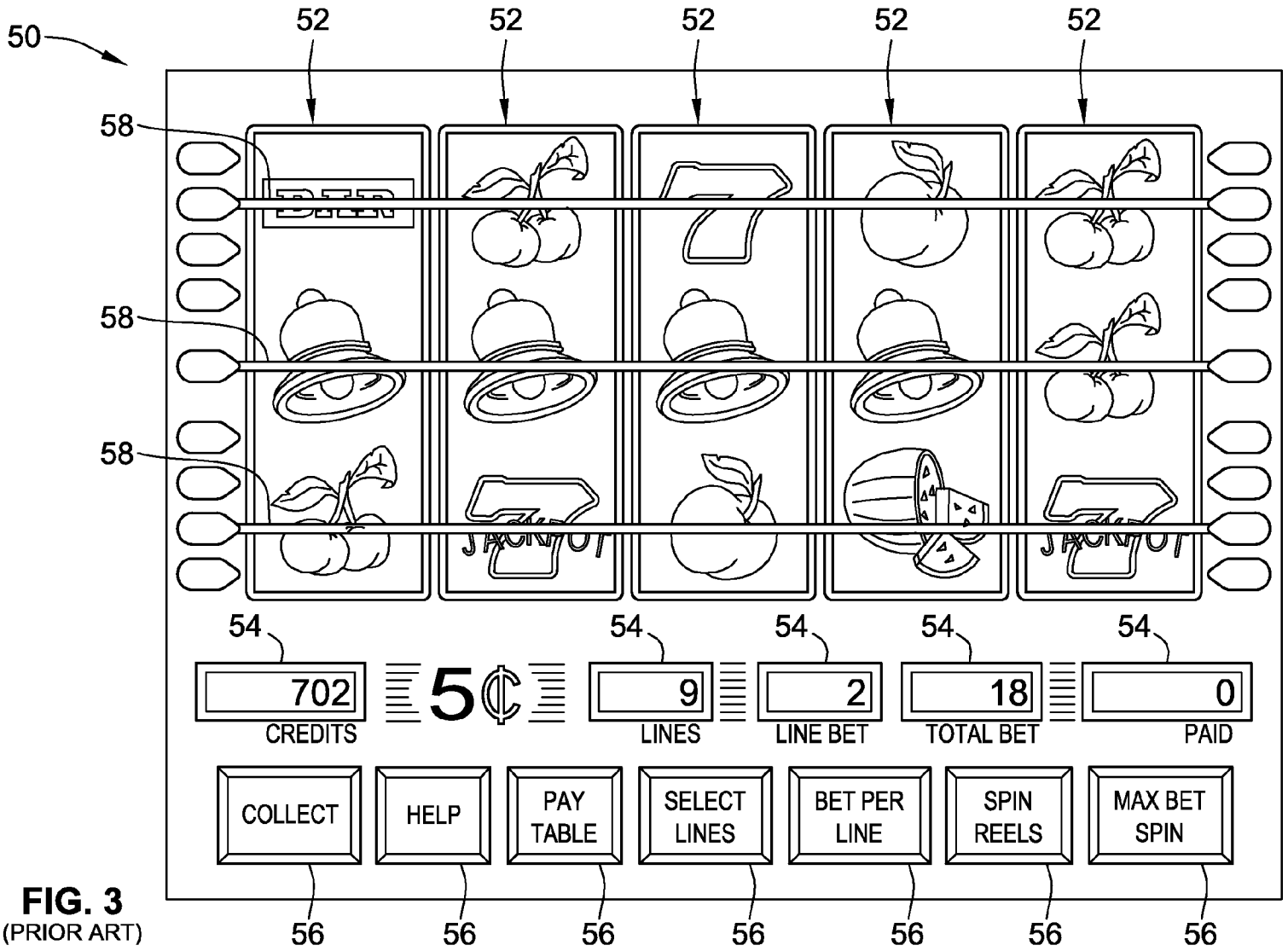
FIG. 3 (PRIOR ART)
FIG. 3 is a screen shot of a representative basic-game screen of a wagering game displayed on a gaming terminal, gaming device, and/or gaming system according to aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
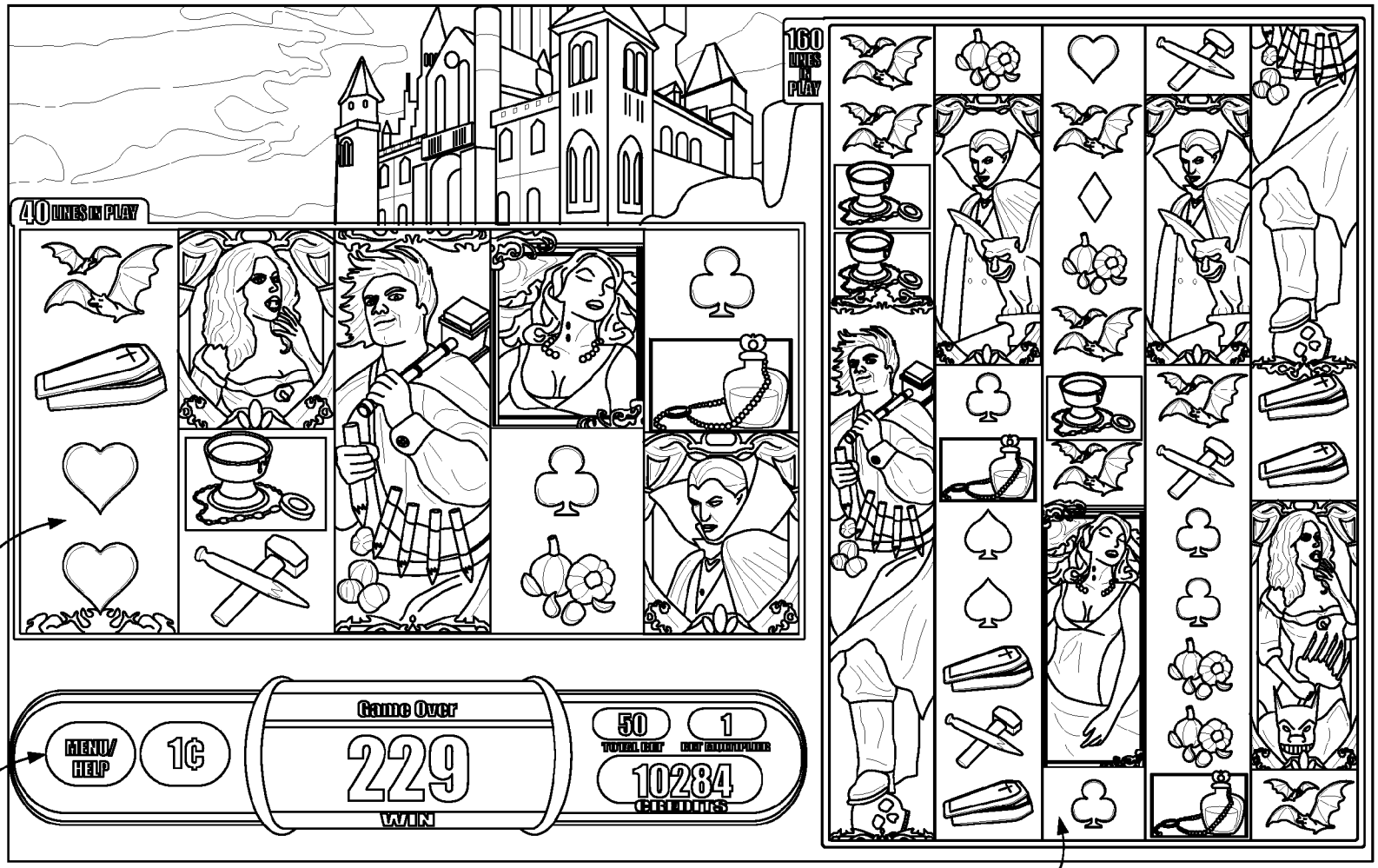
FIG. 4 illustrates a screen shot of the wagering game having a first symbol array and a second symbol array.

FIG. 4 is a screen shot 100 of one of the displays of the gaming system set forth in FIGS. 1-3, such as the display 12 (FIG. 1). The screen shot includes a first symbol array 110, which is a 5×4 array having five symbol-bearing reels. The screen shot 100 also includes a second symbol array 120, which is a 5×12 array having five symbol-bearing reels. Accordingly, the second symbol array 120 includes 60 total symbol positions, while the first symbol array 110 includes only 20 total symbol positions. It should be noted that having more symbol positions in the first symbol array 110 than the second symbol array 120 (or having an equal number of symbol positions within both symbol arrays 110, 120) falls within the scope of the present invention. The screen shot 110 also includes various pieces of information 125 for the wagering game for the player, such as the total credits, the wager amounts, and the payouts from winning symbol combinations.

As will be discussed below in detail, one or more of the five symbol-bearing reels (e.g., the first reel, third reel, and fifth reel) within the first symbol array 110 includes a triggering symbol (or triggering symbols) that causes the placement of a same type of symbol in multiple symbol positions within the second symbol array 120. The triggering symbol is associated with a quantifier (e.g., a number ranging from 3 to 20), which dictates the number of symbol positions within the second symbol array 120 to receive the same symbol, as described below.

Figure 5:
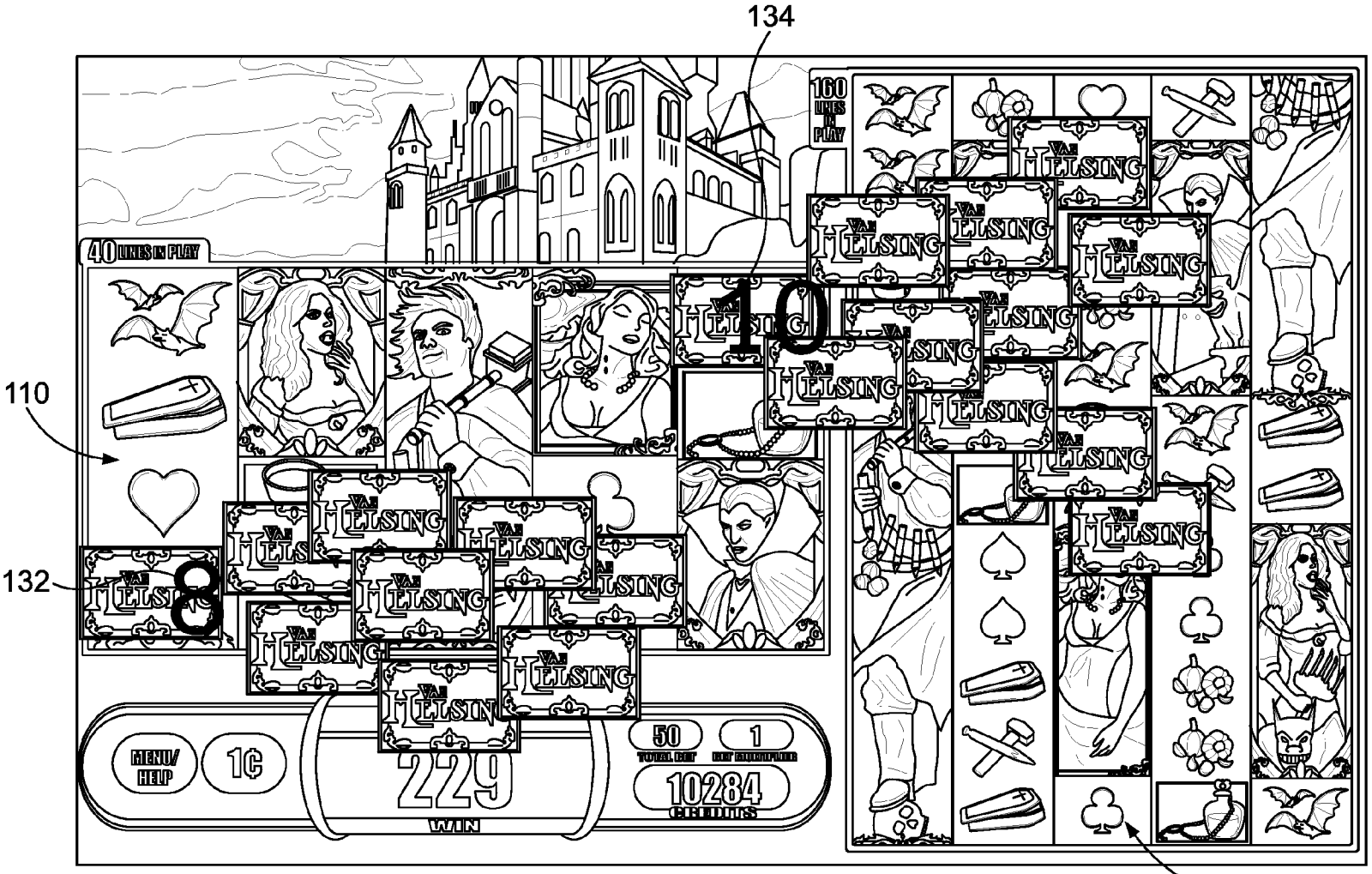
FIG. 5 illustrates a screen shot of the wagering game in which the first symbol array of FIG. 4 has two triggering symbols, causing eighteen (18) like symbols to be placed into the second symbol array.

FIG. 5 is a screen shot 200 in which two distinct triggering symbols 132, 134 (the mystery "Van Helsing" symbols) have stopped on the first reel and fifth reel, respectively. The triggering symbols 132, 134 cause a "spawning" (or transferring) of a certain number of like symbols dictated by the cumulative quantifier value associated with each of the two mystery symbols. The value of the quantifier is preferably superimposed onto its associated triggering symbol 132, 134, such that the quantifier is shown as an image that is generally co-located with, or integrated into the image of, the triggering symbol 132, 134 so as to be readily apparent to the player. In FIG. 5, the quantifier value "10" is superimposed on the triggering symbol 134 on the top symbol position on the fifth reel in FIG. 5. And, the quantifier value "8" is superimposed on the triggering symbol 132 on the bottom symbol position on the first reel in FIG. 5. As a result of the cumulative value of quantifiers of the two mystery symbols 132, 134 being equal to 18 (10+8), 18 "spawned" symbols move across the screen 200 and will eventually come to rest in 18 different symbol positions within the second symbol array 120. Preferably, the 18 "spawned" symbols will remain masked (i.e., like the triggering mystery "Van Helsing" symbols 132, 134) until positioned at the corresponding symbol positions within the second symbol array 120. Further, the movement of these images preferably occurs while at least some of the symbol-bearing reels (and perhaps all five of them) in the second symbol array 120 are in motion, such that the 18 "spawned" symbols are superimposed over moving symbols on the underlying five symbol-bearing reels of the second symbol array 120.

After the symbol-bearing reels of the second symbol array 120 come to a rest (or are nearly stopped), the 18 masked symbols are revealed. For example, the 18 masked symbols can be all "Bat" symbols, all "coffin" symbols, or all "diamond" symbols, etc. In any event, the player experiences a heightened sense of entertainment because he or she knows that the likelihood of achieving a winning symbol combination in the second symbol array 120 will increase because of the addition of 18 like symbols. For example, if the unaffected 42 symbol positions within the second symbol array 120 already include 6 "Bat" symbols, then the addition of 18 more "Bat" symbols means that 24 of the 60 symbol positions have the same "Bat" symbol, which is beneficial to the player. It should also be noted that the present invention contemplates a cumulative value of the summation of the quantifiers that is equal to or greater than the number of symbol positions within the second symbol array 120, such that the entire second symbol array 120 is comprised of only a single type of symbol leading to several winning symbol combinations (assuming multiple pay lines in the second symbol array 120 have been activated by the player).

The type of symbol that is to be placed in the multiple symbol positions within the second symbol array 120 is preferably randomly selected. Or, it could be a function of the type of triggering symbol or a specific combination of triggering symbols. Yet further, the type of symbol to be placed in the multiple symbol positions within the second symbol array 120 could be a function of the player's wager amount (e.g., a larger wager amount yields the spawning of higher value symbols that lead to winning symbol combinations having higher payouts).

In a further alternative, there is no masking of the type of symbol that is to be placed into the multiple symbol positions within the second symbol array 120, such that the player knows the type of the transferred symbol as the underlying reels of the second symbol array 120 move and stop. In this embodiment, as symbols on the second symbol array 120 move past the known transferred symbols, the player would be hoping for like symbols on the underlying symbol-bearing reels to stop adjacent to the transferred symbols.

In the embodiment of FIG. 5, the selection of the symbol positions within the second symbol array 120 that will receive the new transferred symbol is randomly selected by one of the processors (e.g., CPU 30 in FIG. 2) in the gaming system. Additionally, the random selection may exclude symbol positions within the second symbol array 120 that already are (or will be) occupied by the type of symbol that is to be transferred into the second symbol array 120. In a further alternative, predefined patterns may be used to place the transferred symbols into the second symbol array 120, which is discussed in more detail below. And if multiple predefined patterns are available, one of the predefined patterns may be randomly selected in response to the triggering symbol(s) 132, 134 appearing in the first symbol array 110.

Figure 6:
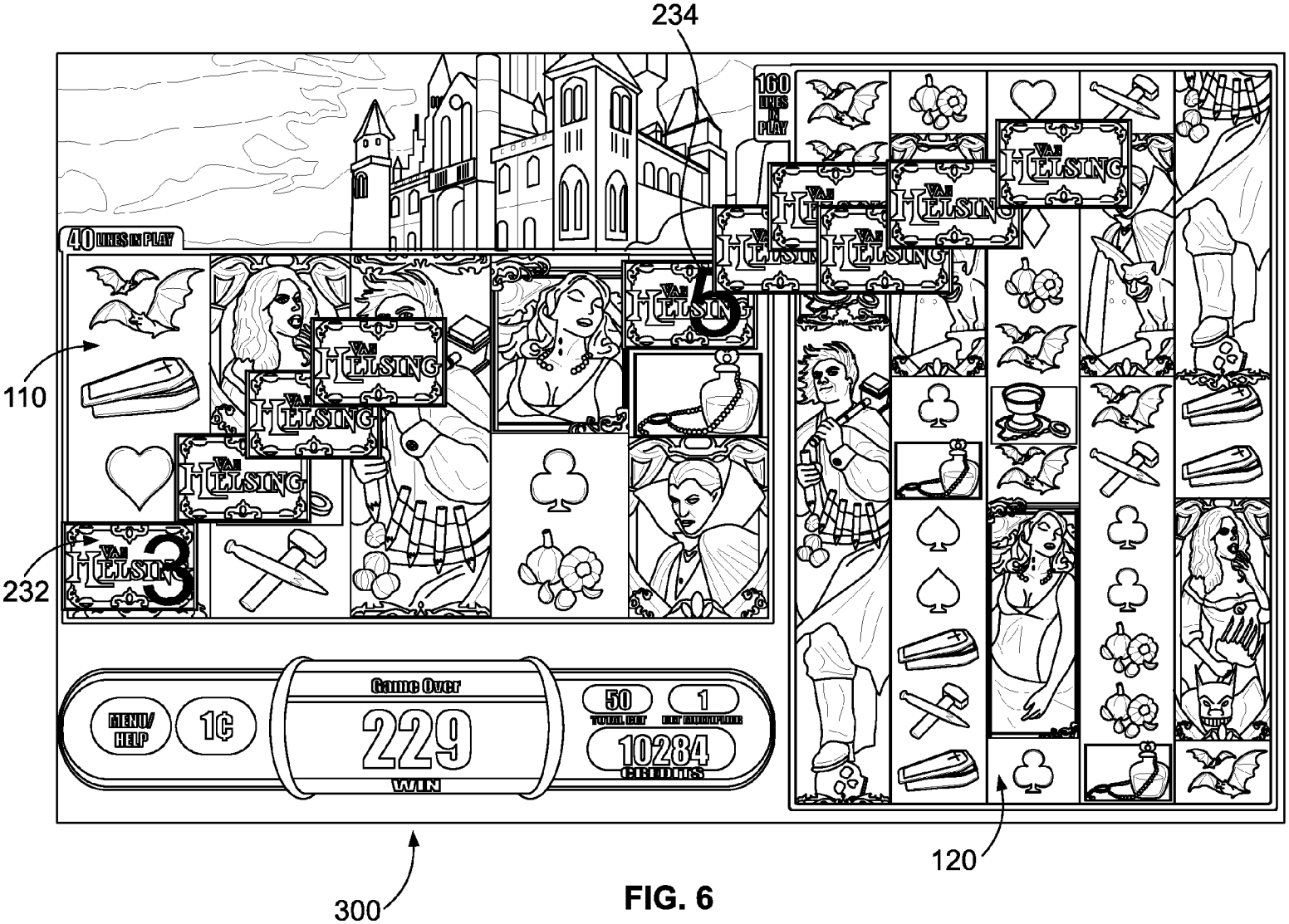
FIG. 6 illustrates a screen shot of the wagering game in which the first symbol array of FIG. 4 has two different triggering symbols relative to FIG. 5, causing eight (8) like symbols to be placed in the second symbol array.
Figure 7A:
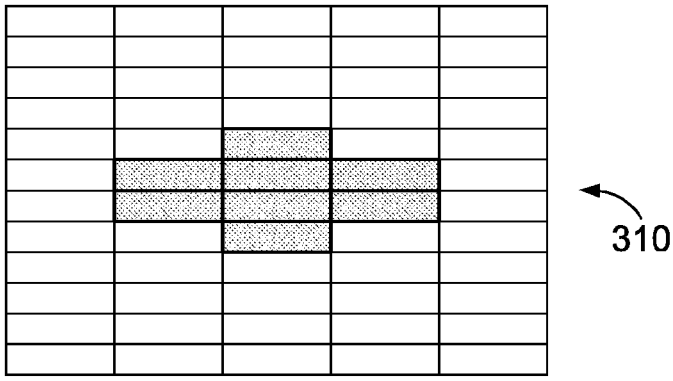
FIG. 7A schematically illustrates a first possible symbol-placement pattern for use in placing the eight (8) symbols into the second symbol array.
Figure 7B:
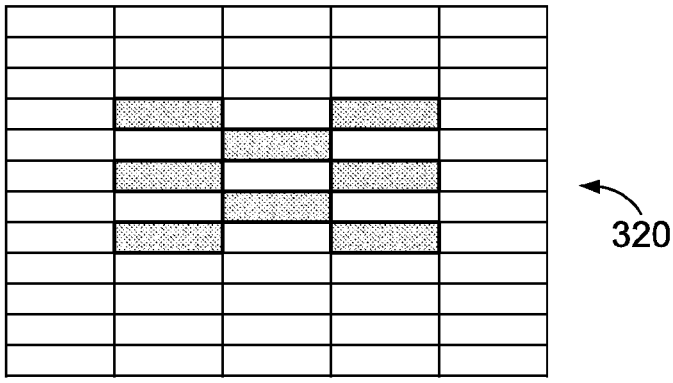
FIG. 7B schematically illustrates a second possible symbol-placement pattern for use in placing the eight (8) symbols into the second symbol array.
Figure 7C:
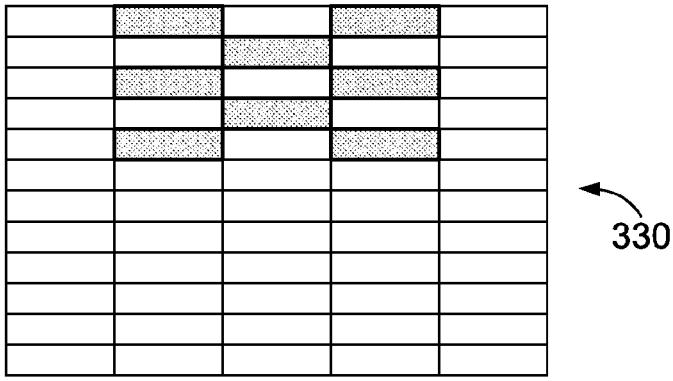
FIG. 7C schematically illustrates a third possible symbol-placement pattern for use in placing the eight (8) symbols into the second symbol array.
Figure 7D:
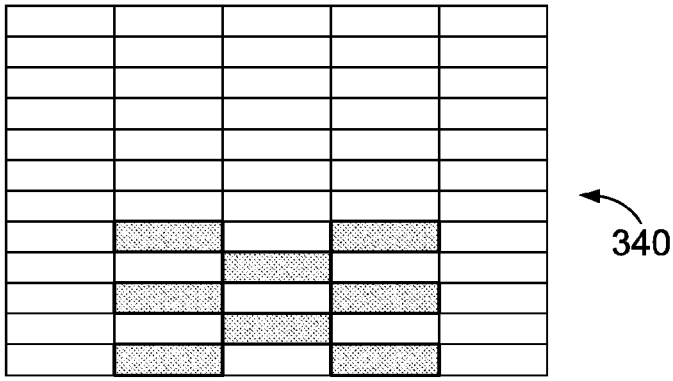
FIG. 7D schematically illustrates a fourth possible symbol-placement pattern for use in placing the eight (8) symbols into the second symbol array.

FIG. 6 presents another screen shot 300 of a different play (i.e. a different spin) in which the first symbol array 110 again includes two triggering symbols 232, 234 on the first reel and the fifth reel, respectively. Here, however, the quantifiers for the two triggering symbols 232, 234 have values of "3" and "5", respectively. Hence, only eight symbol positions within the second symbol array 120 will receive like symbols. FIG. 6 illustrates eight images of these mystery "Van Helsing" symbols in the process of being transferred to (i.e., moving toward) the second symbol array 120 for placement within respective eight symbol positions within the second symbol array 120.

Unlike the random placement of the transferred symbols described relative to FIG. 5, the embodiment of FIG. 6 calls for the placement of the symbols within the second symbol array 120 to be dictated by a specific pattern. The reason for the use of patterns is that the random placement of only eight symbols (FIG. 6) may yield just a slight increase in the probability of achieving a winning combination when such a large number of symbol positions are present in the second symbol array 120. Accordingly, the present invention contemplates the use of certain patterns for situations when there is less than a certain "threshold" number of transferred symbols, as dictated by the quantifier(s) of the triggering symbol(s) 232, 234.

FIGS. 7A-7D illustrates four patterns 310, 320, 330, 340 that can be used for placing eight symbols in the second symbol array 120. As can be seen in FIGS. 7A-7D, each of the four patterns 310, 320, 330, 340 is representative of 5×12 symbol array (like the second symbol array 120) and includes 60 possible positions. In each of the four patterns 310, 320, 330, 340, the eight selected symbol positions (shaded) are adjacently arranged to increase the likelihood that the transferred symbols will achieve one or more winning symbol combinations within the second symbol array 120. It should be noted that some patterns may be arranged to guarantee one or more winning symbol combinations in the second symbol array 120. While only four patterns 310, 320, 330, 340 are illustrated, numerous other patterns may exist for instances when eight symbols are to be placed within the second symbol array 120. One of the possible patterns is selected (preferably randomly selected) for a particular play of the wagering game and that selected pattern is used for placement of the transferred symbols within the second symbol array 120. It is also possible that one of the patterns is a "random pattern" in which case the symbols would be placed in random positions, which may be less favorable to the player. In the illustrated example, the pattern 330 of FIG. 7C has been selected as the pattern to be used for placing the eight transferred symbols in FIG. 6 into the second symbol array 120.

Figure 8:
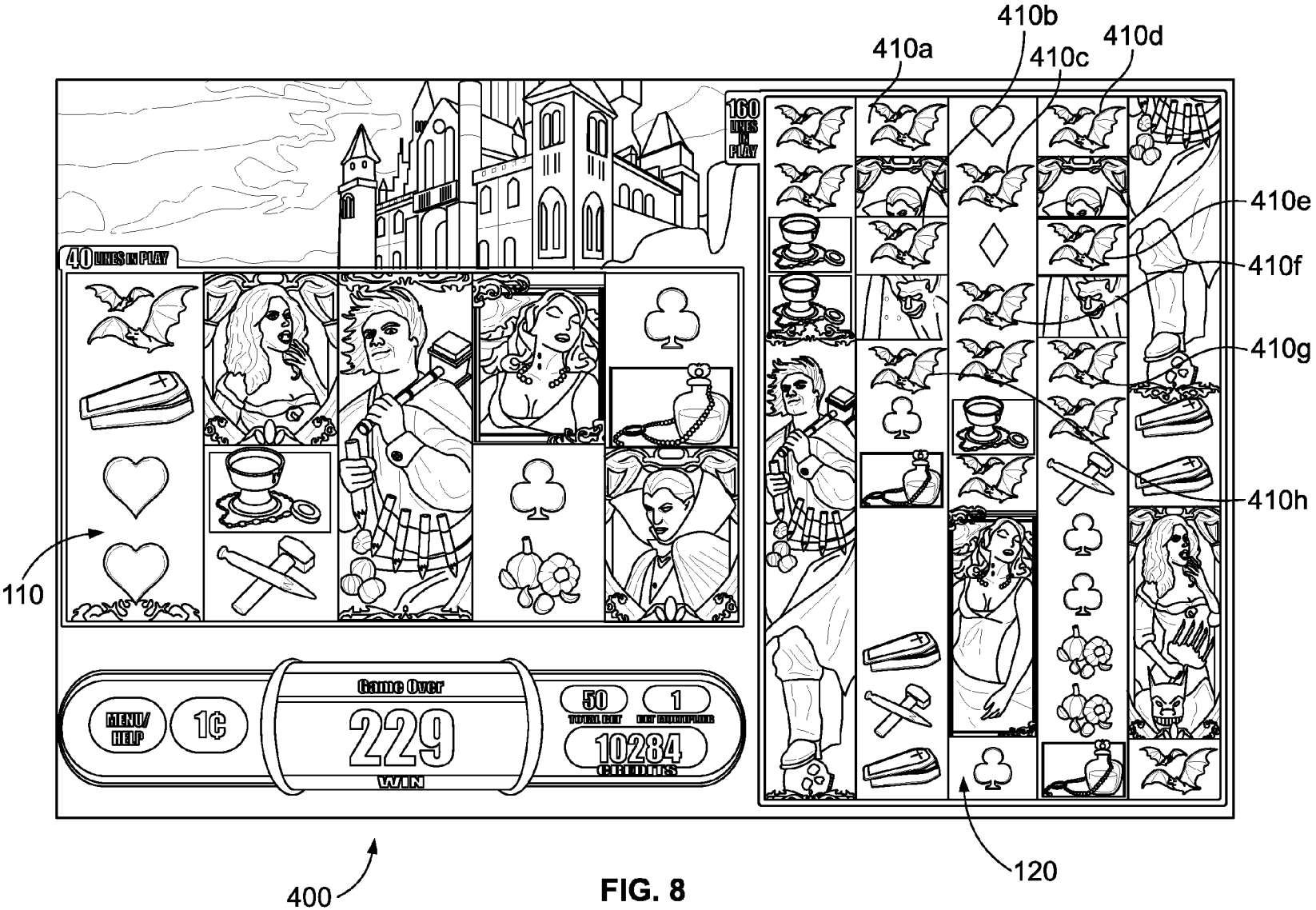
FIG. 8 illustrates a screen shot of the wagering game in which the second symbol array of FIG. 6 has the same symbol placed in the second symbol array as directed by the symbol-placement pattern of FIG. 7C.
Figure 9A:
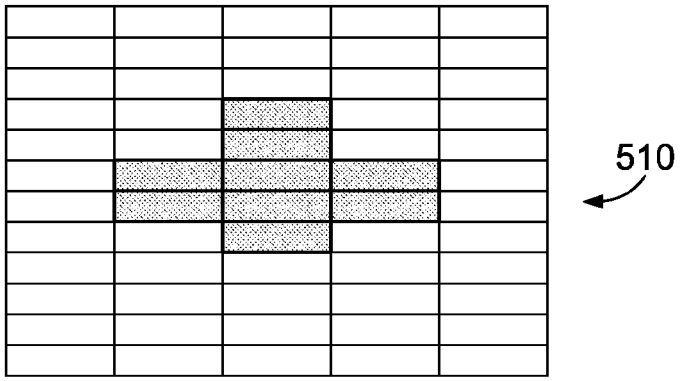
FIG. 9A schematically illustrates a first possible symbol-placement pattern for use in placing the nine (9) symbols into the second symbol array.
Figure 9B:
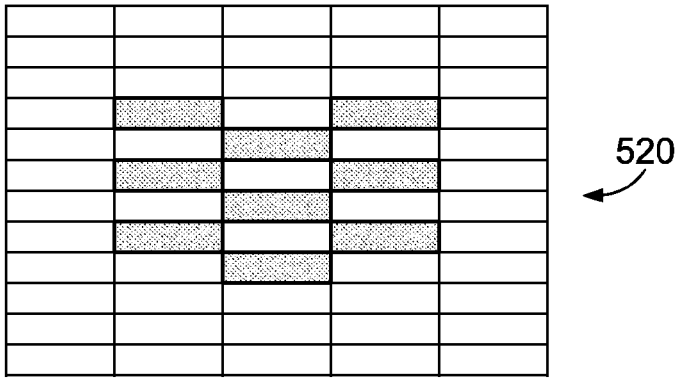
FIG. 9B schematically illustrates a second possible symbol-placement pattern for use in placing the nine (9) symbols into the second symbol array.
Figure 9C:
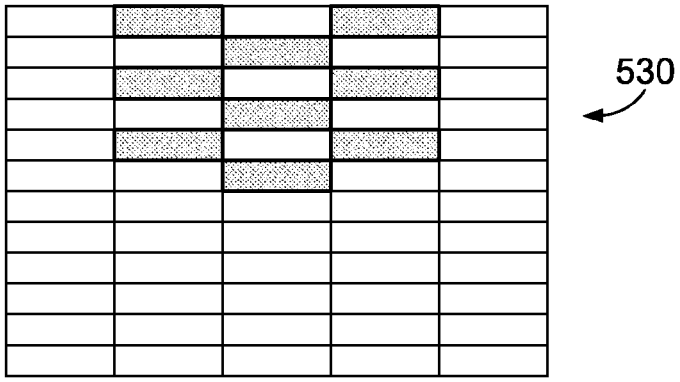
FIG. 9C schematically illustrate a third possible symbol-placement pattern for use in placing the nine (9) symbols into the second symbol array.
Figure 9D:
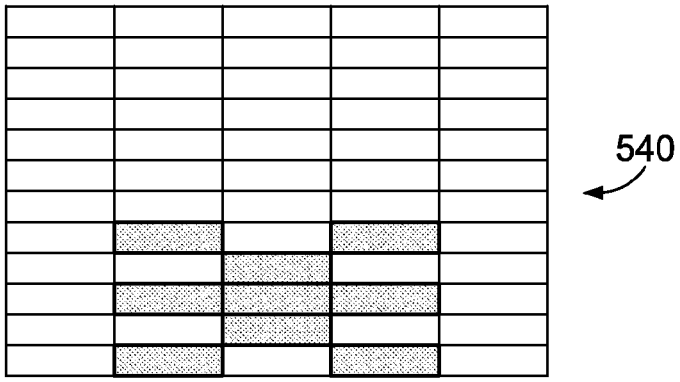
FIG. 9D schematically illustrates a fourth possible symbol-placement pattern for use in placing the nine (9) symbols into the second symbol array.

FIG. 8 illustrates a screen shot 400 that would occur after the screen shot 300 of FIG. 6. The eight images of the mystery "Van Helsing" symbols have already been transferred to the second symbol array 120 and placed in the eight symbol positions dictated by the pattern 330 of FIG. 7C. The underlying symbol-bearing reels of the second symbol array 120 have now stopped, and the mystery "Van Helsing" symbol images have vanished, which reveals eight underlying "Bat" symbols 410*a*, 410*b*, 410*c*, 410*d*, 410*e*, 410*f*, 410*g*, 410*h* at the eight symbol positions corresponding to the symbol-placement pattern 330 of FIG. 7C. It should also be noted that the triggering symbols 232, 234 in the screen shot 300 of FIG. 6 (the mystery "Van Helsing" symbols) in the first symbol array 110 have vanished in the screen shot 400 of FIG. 8, revealing a "heart" symbol and a "club" symbol, respectively. The first symbol array 110 is also evaluated with the inclusion of the "heart" symbol and the "club" symbol for any winning symbol combinations.

FIGS. 9A-9D illustrates a second set of symbol placement patterns 510, 520, 530, 540 that would be used in the situation where there are nine transferred symbols (as opposed to the eight transferred "Bat" symbols of FIGS. 6-8), as dictated by the cumulative value of the quantifier(s) of the triggering symbol(s) in the first symbol array 110 being equal to nine. As described above, several other patterns could be used as well when there are to be nine transferred symbols. In embodiments in which symbol placement patterns are only used when the cumulative value the quantifier is less than a certain threshold number, each possible quantifier value that is less than the threshold number has a corresponding set of patterns. In other words, if the threshold number is "10" (such that 10 or more transferred symbols results in a random placement within the second symbol array 120), there should be sets of symbol placement patterns corresponding to a quantifier value of "9" (e.g., patterns 510, 520, 530, 540 of FIGS. 9A-9D), "8" (e.g., patterns 310, 320, 330, 340 of FIGS. 7A-7D), "7", "6", "5", "4", and "3" (assuming a quantifier value of "3" was the minimal quantifier associated with any triggering symbol).

Regarding the triggering symbols 132, 134, 232, 234, the quantifier value associated with each one could be preset for each triggering symbol such that it never changes. Or, for each play or set of plays, the quantifier value can be assigned (preferably randomly) to each triggering symbol 132, 134, 232, 234 within the symbol-bearing reels of the first symbol array 110. For example, there may be only six triggering symbols on the five symbol-bearing reels of the first symbol array 110, and for each spin, the quantifier value (e.g., between a range of '3" and "10") is randomly assigned to each of the six triggering symbols. The quantifier value may also be varied based on the amount of the wager that the player makes on each spin, such that the probability of achieving higher quantifier values within a predefined range is increased for larger wager amounts through a weighting scheme. Or, the range of quantifier values, itself, may be higher far larger wager amounts.

Additionally, while the present invention has been described in a manner in which each triggering symbol causes the same symbol to be placed in multiple symbol locations in the second symbol array 120, the triggering symbols themselves may dictate which type of symbol is to be transferred to the multiple symbol locations within the second symbol array 120. In that instance, two different triggering symbols may cause the placement of two different types of symbols (perhaps in large quantities) within the second symbol array 120. For example, when considering FIG. 5, the triggering symbol 132 on the first reel may cause eight "bat" symbols to be randomly placed (or placed in a pattern) in the second symbol array 120, while the triggering symbol 134 on the fifth reel may cause ten "coffin" symbols to be randomly placed (or placed in a pattern) in the second symbol array 120. Hence, the resultant second symbol array 120 may have a disproportionately high number of "coffin" symbols and "bat" symbols, yielding more winning symbol combinations that include those two types of symbols.

Any of the methods described herein can include machine readable instructions for execution by: (a) a processor, (b) a controller, and/or (c) any other suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well known manner (e.g., it may be implemented by an application specific integrated circuit (ASIC), a programmable logic device (PLD), a field programmable logic device (FPLD), discrete logic, etc.). Also, some or all of the machine readable instructions represented in any flowchart depicted herein may be implemented manually. Further, although specific algorithms are described with reference to flowcharts depicted herein, persons of ordinary skill in the art will readily appreciate that many other methods of implementing the example machine readable instructions may alternatively be used. For example, the order of execution of the blocks may be changed, and/or some of the blocks described may be changed, eliminated, or combined.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A method of operating a gaming system, the gaming system including game-logic circuitry and a regulated gaming machine, the gaming machine primarily dedicated to playing at least one casino wagering game, the gaming machine including a value input device, the method comprising:

detecting, via at least one of the one or more electronic input devices, a physical item associated with a monetary value that establishes a credit balance;

initiating the casino wagering game in response to an input indicative of a wager covered by the credit balance;

displaying, on at least one of one or more electronic display devices, a first symbol array and a second symbol array;

in response to a triggering symbol appearing in the first symbol array, placing a first symbol into a number of symbol positions within the second symbol array, the number being defined by a quantifier associated with the triggering symbol;

providing an award based on one or more winning symbol combinations in the second array with the first symbols placed in the symbol positions; and receiving, via at least one of the one or more electronic input devices, a cashout input that initiates a payout from the credit balance.

2. The method of claim 1, wherein the first symbol array is populated by a first plurality of symbol-bearing reels and the second symbol array is populated by a second plurality of symbol-bearing reels, the second plurality is greater than the first plurality.

3. The method of claim 2, wherein the placing of the symbols includes (i) stopping the first plurality of symbol-bearing reels such that the triggering symbol appears in the first symbol array and (ii) while the second plurality of symbol-bearing reels are moving, moving images associated with the first symbol from the first symbol array to the second symbol array.

4. The method of claim 3, wherein the identity of the first symbol is initially masked as the images are moved from the first symbol array to the second symbol array, and the placing of the symbols further includes revealing the first symbols at the respective symbol positions in the second symbol array after at least one of the second plurality of symbol-bearing reels has stopped moving.

5. The method of claim 4, wherein the second symbol array is populated by a plurality of symbol-bearing reels, and the placing at least partially occurs while the plurality of symbol-bearing reels are moving.

6. The method of claim 1, wherein the placing includes initially masking the identity of the first symbol when placing the first symbols into the symbol positions in the second symbol array, and subsequently revealing the first symbols at the respective symbol positions.

7. The method of claim 1, wherein the placing includes moving images associated with the first symbol from the first symbol array to the symbol positions within the second symbol array prior to the awarding.

8. The method of claim 1, further including providing an award for winning symbol combinations located in the first symbol array.

9. The method of claim 1, wherein the symbol positions in the second symbol array are randomly selected.

10. The method of claim 1, wherein the symbol positions in the second symbol array are in a predetermined pattern in response to the number being below a certain threshold.

11. The method of claim 10, wherein the symbol positions in the predetermined pattern are located in a manner to increase the likelihood of achieving a winning symbol combination in the second symbol array.

12. The method of claim 1, wherein multiple predetermined patterns for the symbol positions in the second symbol array are available, and the method further includes selecting one of the multiple predetermined patterns to be used in the placing act in response to the number being below a certain threshold.

13. The method of claim 1, wherein the quantifier is displayed in the form of a numerical value image and is co-located with the triggering symbol.

14. The method of claim 1, further including, in response to a second triggering symbol appearing in the first symbol array, placing the first symbol into a second number of symbol positions within the second symbol array, the second number being defined by a second quantifier associated with the second triggering symbol.

15. The method of claim 1, further including, in response to a second triggering symbol appearing in the first symbol array, placing a second symbol into a second number of symbol positions within the second symbol array, the second number being defined by a second quantifier associated with the second triggering symbol, the second symbol being different from the first symbol.

16. The method of claim 1, wherein the triggering symbol in the first symbol array is a mystery symbol, and the first symbols placed in the second symbol array are mystery symbols that appear to originate from the triggering symbol and to be transferred to the symbol positions in the second symbol array.

17. A method of operating a gaming system, the gaming system including game-logic circuitry and a regulated gaming machine, the gaming machine primarily dedicated to playing at least one casino wagering game, the gaming machine including a value input device, the method comprising:

detecting, via at least one of the one or more electronic input devices, a physical item associated with a monetary value that establishes a credit balance;

initiating the casino wagering game in response to an input indicative of a wager covered by the credit balance;

displaying, on at least one of one or more electronic display devices, a first plurality of symbol-bearing reels that form a first symbol array, the plurality of symbol-bearing reels including at least one triggering symbol, the triggering symbol including a quantifier associated therewith;

displaying, on at least one of the one or more display devices, a second plurality of symbol-bearing reels that form a second symbol array, the second symbol array being larger than the first symbol array;

moving and stopping the first plurality of symbol-bearing reels to populate the first symbol array with symbols;

in response to a triggering symbol appearing in the first symbol array, filling a number of symbol positions within the second symbol array with a first symbol, the number being defined by the quantifier associated with the triggering symbol;

moving and stopping the second plurality of symbol-bearing reels to populate the second symbol array with symbols, the second symbol array including the symbol positions filled with the first symbol after the second plurality of symbol-bearing reels are stopped;

providing an award based on one or more winning symbol combinations in the second array with the first symbols filled in the symbol positions; and receiving, via at least one of the one or more electronic input devices, a cashout input that initiates a payout from the credit balance.

18. The method of claim 17, wherein the filling occurs prior to the stopping of the second plurality of symbol-bearing reels.

19. The method of claim 17, wherein the filling includes initially masking the identity of the first symbol when placing the first symbols into the symbol positions on the second symbol array, and subsequently revealing the first symbols at the respective symbol positions.

20. A method of operating a gaming system, the gaming system including game-logic circuitry and a regulated gaming machine, the gaming machine primarily dedicated to playing at least one casino wagering game, the gaming machine including a value input device, the method comprising:

detecting, via at least one of the one or more electronic input devices, a physical item associated with a monetary value that establishes a credit balance;

initiating the casino wagering game in response to an input indicative of a wager covered by the credit balance;

displaying, on at least one of one or more electronic display devices, a first symbol array and a second symbol array;

in response to a triggering symbol appearing in the first symbol array, selecting, by at least one of one or more processors, a symbol-placement pattern from a first set of symbol-placement patterns for the second array, the selected symbol-placement pattern including multiple symbol positions;

placing a first symbol into the multiple symbol positions defined by the selected symbol-placement pattern for the second symbol array;

providing an award based on one or more winning symbol combinations in the second array with the first symbols placed into the symbol positions; and receiving, via at least one of the one or more electronic input devices, a cashout input that initiates a payout from the credit balance.

21. The method of claim 20, wherein the selecting is by a random selection.

22. The method of claim 20, wherein the first set of symbol-placement patterns is used in response to a first value for a quantifier associated with the triggering symbol.

23. The method of claim 22, wherein a second set of symbol-placement patterns is used in response to a second value for the quantifier associated with a second triggering symbol, and the method further includes, in response to the second triggering symbol appearing in the first symbol array and having the second value for the quantifier, selecting, by at least one of the one or more processors, a symbol-placement pattern from the second set of symbol-placement patterns for the second array.

24. A method of operating a gaming system, the gaming system including game-logic circuitry and a regulated gaming machine, the gaming machine primarily dedicated to playing at least one casino wagering game, the gaming machine including a value input device, the method comprising:

detecting, via at least one of the one or more electronic input devices, a physical item associated with a monetary value that establishes a credit balance;

initiating the casino wagering game in response to an input indicative of a wager covered by the credit balance;

displaying, on at least one of one or more electronic display devices, a first symbol array and a second symbol array that is distinct from the first symbol array, the first symbol array capable of displaying a first triggering symbol and a second triggering symbol, the first triggering symbol being associated with a first number "n", the second triggering symbol being associated with a second number "m", the second number "m" being larger than the first number "n";

in response to only the first triggering symbol appearing in the first symbol array, placing a first symbol into "n" number of symbol positions within the second symbol array;

in response to only the second triggering symbol appearing in the first symbol array, placing the first symbol into "m" number of symbol positions within the second symbol array;

in response to both the first triggering symbol and the second triggering symbol appearing in the first symbol array, placing the first symbol into "x" number of symbol positions within the second symbol array, wherein the number "x" is equal to the summation of the number "n" and the number "m";

providing an award based on winning symbol combinations in the second array with the first symbols placed into the symbol positions; and receiving, via at least one of the one or more electronic input devices, a cashout input that initiates a payout from the credit balance.

25. The method of claim 24, wherein in response to only the first triggering symbol appearing in the first symbol array, the placing of the first symbol into "n" number of symbol positions is directed by predefined symbol-placement pattern within the second symbol array.

26. The method of claim 25, wherein in response to only the second triggering symbol appearing in the first symbol array, placing the first symbol into "m" number of symbol positions is directed by a random selection of the symbol positions of the second symbol array.

27. The method of claim 26, wherein in response to both the first triggering symbol and the second triggering symbol appearing in the first symbol array, placing the first symbol into "x" number of symbol positions within the second symbol array is directed by a random selection of the symbol positions of the second symbol array.

28. A gaming system for playing a wagering game, comprising:

a regulated gaming machine primarily dedicated to playing at least one casino wagering game, the gaming machine including one or more electronic input devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

display, on at least one of one or more electronic display devices, a first symbol array and a second symbol array, in response to a triggering symbol appearing in the first symbol array, place a first symbol into a number of symbol positions within the second symbol array, the number being defined by a quantifier associated with the triggering symbol, provide an award based on one or more winning symbol combinations in the second array with the first symbols placed in the symbol positions; and receive, via at least one of the one or more electronic input devices, a cashout input that initiates a payout from the credit balance.

29. A gaming system for playing a wagering game, comprising:

a regulated gaming machine primarily dedicated to playing at least one casino wagering game, the gaming machine including one or more electronic input devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

display, on at least one of one or more electronic display devices, a first plurality of symbol-bearing reels that form a first symbol array, the plurality of symbol-bearing reels including at least one triggering symbol, the triggering symbol including a quantifier associated therewith, display, on at least one of one or more electronic display devices, a second plurality of symbol-bearing reels that form a second symbol array, the second symbol array being larger than the first symbol array, move and stop the first plurality of symbol-bearing reels to populate the first symbol array with symbols, in response to a triggering symbol appearing in the first symbol array, fill a number of symbol positions within the second symbol array with a first symbol, the number being defined by the quantifier associated with the triggering symbol, move and stop the second plurality of symbol-bearing reels to populate the second symbol array with symbols, the second symbol array including the symbol positions filled with the first symbol after the second plurality of symbol-bearing reels are stopped, provide an award based on one or more winning symbol combinations in the second array with the first symbols filled in the symbol positions; and receive, via at least one of the one or more electronic input devices, a cashout input that initiates a payout from the credit balance.

30. A gaming system for playing a wagering game, comprising:

a regulated gaming machine primarily dedicated to playing at least one casino wagering game, the gaming machine including one or more electronic input devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

display, on at least one of the one or more electronic display devices, a first symbol array and a second symbol array;

in response to a triggering symbol appearing in the first symbol array, select, by at least one of the one or more processors, a symbol-placement pattern from a first set of symbol-placement patterns for the second array, the symbol-placement pattern including multiple symbol positions, place a first symbol into the multiple symbol positions defined by the selected symbol-placement pattern for the second symbol array, provide an award based on one or more winning symbol combinations in the second array with the first symbols placed into the symbol positions; and receive, via at least one of the one or more electronic input devices, a cashout input that initiates a payout from the credit balance.

31. A gaming system for playing a wagering game, comprising:

a regulated gaming machine primarily dedicated to playing at least one casino wagering game, the gaming machine including one or more electronic input devices; and game-logic circuitry configured to:

detect, via at least one of the one or more electronic input devices, a physical item associated with a monetary value that establishes a credit balance;

initiate the casino wagering game in response to an input indicative of a wager covered by the credit balance;

display, on at least one of the one or more display devices, a first symbol array and a second symbol array that is distinct from the first symbol array, the first symbol array capable of displaying a first triggering symbol and a second triggering symbol, the first triggering symbol being associated with a first number "n", the second triggering symbol being associated with a second number "m", the second number "m" being larger than the first number "n", in response to only the first triggering symbol appearing in the first symbol array, place a first symbol into "n" number of symbol positions within the second symbol array, in response to only the second triggering symbol appearing in the first symbol array, place the first symbol into "m" number of symbol positions within the second symbol array, in response to both the first triggering symbol and the second triggering symbol appearing in the first symbol array, place the first symbol into "x" number of symbol positions within the second symbol array, wherein the number "x" is equal to the summation of the number "n" and the number "m", provide an award based on winning symbol combinations in the second array with the first symbols placed into the symbol positions; and receive, via at least one of the one or more electronic input devices, a cashout input that initiates a payout from the credit balance.

* * * * *